US010138643B2

(12) United States Patent
Drechsel

(10) Patent No.: US 10,138,643 B2
(45) Date of Patent: Nov. 27, 2018

(54) SYSTEMS AND METHODS FOR REMOVING STANDING WATER FROM A COVER

(71) Applicant: Cover-Pools Incorporated, Salt Lake City, UT (US)

(72) Inventor: LaMont Drechsel, Salt Lake City, UT (US)

(73) Assignee: Cover-Pools Incorporated, Salt Lake City, UT (US)

( * ) Notice: Subject to any disclaimer, the term of this patent is extended or adjusted under 35 U.S.C. 154(b) by 66 days.

(21) Appl. No.: 14/103,586

(22) Filed: Dec. 11, 2013

(65) Prior Publication Data

US 2014/0157508 A1 Jun. 12, 2014

Related U.S. Application Data

(60) Provisional application No. 61/735,985, filed on Dec. 11, 2012.

(51) Int. Cl.
*E04H 4/14* (2006.01)
*E04H 4/10* (2006.01)

(52) U.S. Cl.
CPC ..... *E04H 4/10* (2013.01); *E04H 4/14* (2013.01)

(58) Field of Classification Search
CPC ..... E04H 4/10; E04H 4/101; B65D 88/38; F17D 1/14
USPC ..... 4/498, 500, 502; 220/419
See application file for complete search history.

(56) References Cited

U.S. PATENT DOCUMENTS 2,073,784 A * 3/1937 Day ..... C02F 1/5281 137/892
3,579,657 A * 5/1971 Gurrieri ..... E04H 4/10 210/474
4,203,174 A * 5/1980 Schults ..... E04H 4/101 134/122 R
4,313,421 A * 2/1982 Trihey ..... E04H 4/103 126/566
4,318,421 A * 3/1982 Ward ..... E04H 4/10 137/135
4,622,137 A * 11/1986 Kessler ..... B01D 29/668 210/167.13
4,819,681 A * 4/1989 Hodak ..... E04H 4/10 137/1
4,834,138 A * 5/1989 Dellasso ..... E04H 4/10 137/150
5,425,143 A * 6/1995 Kalandovsky ..... E04H 4/101 242/388.6
5,802,629 A * 9/1998 Zietek ..... E04H 4/10 4/496
5,946,743 A * 9/1999 Hashmi ..... E04H 4/10 4/496

(Continued)

OTHER PUBLICATIONS

Cover-Pools Incorporated, "Cover Pools Large Brochure", Known at least as early as Dec. 2, 2013, 24 pages.

(Continued)

*Primary Examiner* — Erin Deery
(74) *Attorney, Agent, or Firm* — Dorsey & Whitney LLP

(57) ABSTRACT

A remotely mounted pump system for removal of standing water from a pool/spa cover includes a pump that is remotely located from the cover, and is not positioned on the cover. The system may further include at least one hose which may be removable from the cover or secured with the cover.

19 Claims, 6 Drawing Sheets

(56) References Cited

U.S. PATENT DOCUMENTS

| | | | | |
|---|---|---|---|---|
| 6,338,169 | B1 * | 1/2002 | DeGarie | E04H 4/106 220/216 |
| 6,453,950 | B1 * | 9/2002 | Smith | B29C 47/0023 138/115 |
| 6,954,948 | B1 * | 10/2005 | Asack | E04H 4/10 4/498 |
| 6,978,493 | B2 * | 12/2005 | Stanneck | E04H 4/10 4/498 |
| 7,434,792 | B2 * | 10/2008 | Nagasaka | A61H 33/02 4/622 |
| 2006/0081520 | A1 * | 4/2006 | Lord | B01D 35/0273 210/153 |
| 2009/0188535 | A1 * | 7/2009 | Taylor | B08B 17/00 134/104.2 |
| 2015/0000764 | A1 * | 1/2015 | Johnson | F17D 1/14 137/343 |

OTHER PUBLICATIONS

Dultmeier Sales, LLC, "FloJet Motor Driven Diaphragm Pumps", Known at least as early as Dec. 10, 2012, 1 page.

* cited by examiner

SYSTEMS AND METHODS FOR REMOVING STANDING WATER FROM A COVER

CROSS REFERENCE TO RELATED APPLICATION

This application claims the benefit of priority under 35 USC 119(e) to U.S. Application No. 61/735,985, filed Dec. 11, 2012 and entitled "Systems and Methods for Removing Standing Water from a Cover," which is hereby incorporated by reference in its entirety.

TECHNICAL FIELD

The present disclosure relates to systems and methods for removing standing water. More specifically, the present disclosure relates to methods and systems for removing standing water from the cover of a pool, or other such structure, such as, for example, a spa or a hot tub.

BACKGROUND

A cover may be used when a swimming pool, spa, hot tub or wading pool is not in use to prevent rain water, debris and the like from getting into the water. The cover may also serve as a safety device to reduce the risk of drowning by inhibiting the access of children or unauthorized users to the water. However, when the cover is extended over the pool and is in use, water may accumulate on top of the cover. Water may accumulate due to a hole or leak in the cover, from over-spray or misdirected sprinklers, or from rain and snow.

While the accumulated water can be left on top of the cover, it presents both health and safety hazards and may cause damage to the pool/spa cover. For example, isolated puddles tend to migrate toward a depression in the cover thereby creating a larger collection of water in a single location that may create an unwanted load on the cover, which may damage the cover. For at least this reason, removal of standing water is generally desirable.

Currently available options for removing standing water exist, including manually removing small amounts of water with a vacuum hose or the like. With currently available technology, a pump placed directly on the cover may also remove water. As shown in FIG. 1, which illustrates a pool/spa 5, having a cover 10 with standing water 15, an on-cover pump 20 may be located on the cover 10 to remove water. The pump creates a low spot or depression in the cover, in which the standing water collects. The pump 20 may also be coupled to a hose 25, the hose 25 having a first end coupled to the pump 20 and a second end for placement in the grass or surrounding deck area 30. As the pump 20 takes in the water 15 from the cover, it is discharged onto the grass or deck area through the second end of the hose 25. Once the water has been removed, the pump 20 may be left on the cover 10, thereby creating a depression to allow continual consolidation of water. The pump may be an automatic pump that senses accumulation of water and turns on or off as needed.

However, the on-cover pump 20 requires user compliance. That is, while the on-cover pump is commercially available, its use is restricted because it requires additional time to place the pump when the cover is in use, remove the pump when the cover is not in use or when the cover is being removed, set the hose appropriately and monitor both the pump and the hose to ensure that the pump does not tip over on the cover and/or the hose does not get moved or disconnected from the pump, thereby rendering the on-cover pump ineffective.

Against this backdrop, the present disclosure was developed.

The information included in this Background section of the specification, including any references cited herein and any description or discussion thereof, is included for technical reference purposes only and is not to be regarded subject matter by which the scope of the invention is to be bound.

SUMMARY

One aspect of the subject matter of the present disclosure addresses the aforementioned needs by providing methods and systems for removing standing water from a pool/spa cover. In one aspect, the system may include a pump mounted in a remote location relative to the pool/spa cover, a weighting mechanism coupled to the pool/spa cover to create a depression into which standing water will accumulate; and at least one hose having a first end and a second end, the first end coupled to an inlet in the pump and the second end configured to be received in the depression in the pool/spa cover. The remote location may be a roller mechanism housing or a recess in a pool deck. In one aspect, the system further includes a drain, and the pump is coupled to the drain via a fluid conduit. In one aspect, the system further includes a retraction mechanism coupled to the pump and the pool/spa cover via the hose. In some aspects, the hose is a ribbon hose or a flat hose. In one aspect, the hose is integral with the pool/spa cover. The hose may further include a detachable hose portion coupled to the second end of the hose. In one aspect, the system further includes channel weights positioned in or on the cover to create a channel for the standing water to collect in the depression in the cover.

A system for removal of standing water from a pool/spa cover is disclosed. In one aspect, the system includes a pump mounted in a remote location relative to the pool/spa cover and at least one hose having a first end and a second end, the first end coupled to an inlet in the pump and the second end comprising a weighting mechanism to create a depression in the pool/spa cover into which standing water will accumulate, the second end configured to be received in the depression in the pool/spa cover. The remote location may be a roller mechanism housing or a recess in a pool deck. In one aspect, the system further includes a drain, and the pump is coupled to the drain via a fluid conduit. In one aspect, the system further includes a retraction mechanism coupled to the pump and the pool/spa cover via the hose. In some aspects, the hose is a ribbon hose or a flat hose. In one aspect, the hose is integral with the pool/spa cover. The hose may further include a detachable hose portion coupled to the second end of the hose. In one aspect, the system further includes channel weights positioned in or on the cover to create a channel for the standing water to collect in the depression in the cover.

A method of removing standing water from a pool/spa cover is disclosed. In one aspect, the method includes coupling a first end of a hose to a remotely mounted pump, the pump mounted in a recess in a pool deck or in a roller mechanism housing; extending a second end of the hose onto or through the cover to a depression in the cover at which standing water has accumulated, wherein the depression is created by a weighting mechanism positioned on the cover or about the second end of the hose; and removing standing water from the depression in the cover by turning on the pump and drawing the standing water through the hose into the pump. The method may further include creating a channel in the cover to direct the standing water to the depression. In one aspect, the method includes retracting the hose from the depression. In one aspect, the retracting operation is at least partially performed by a retracting mechanism positioned in the roller mechanism housing. In one aspect, the extending operation is at least partially performed by the retracting mechanism positioned in the roller mechanism housing. In one aspect, the extending operation is at least partially performed by extending the pool/spa cover.

This summary is provided to introduce a selection of concepts in a simplified form that are further described below in the Detailed Description. This Summary is not intended to identify key features or essential features of the claimed subject matter, nor is it intended to be used to limit the scope of the claimed subject matter. Other features, details, utilities, and advantages of the present invention will be apparent from the following more particular written description of various embodiments of the invention as further illustrated in the accompanying drawings and defined in the appended claims.

BRIEF DESCRIPTION OF THE DRAWINGS

The present disclosure, both as to its organization and manner of operation, may be understood by reference to the following description, taken in connection with the accompanying drawings, in which.

DETAILED DESCRIPTION

Disclosed herein is a remotely mounted pump system for removal of standing water from a pool/spa cover. Advantageously, the system includes a remotely mounted pump that is not located on the cover, but is rather remotely mounted in another location. The pump does not require a user to place and alternately remove the pump during use and non-use of the cover and does not require monitoring to ensure the pump has not become mis-positioned on the cover. Further, the remote mounted pump may be manually turned on or there may be a moisture sensor at the end of the hose operably connected to the pump or central control unit to automatically turn on the pump. In some embodiments, the conduit or hose, or a portion thereof, may also be integral or integrated with the cover and does not require the user to place or move the hose. Thus, the configuration increases user compliance and safety by providing a timesaving and easy to use standing water removal system.

The pool/spa cover may be an automatic cover (automatically closed and opened), a semi-automatic cover (manually pulled closed and automatically opened or vice versa), a manual cover (opened and closed without the use of a motor) or other type of cover that helps to retain heat and chemicals and keeps leaves and debris out. In one embodiment, the cover is a retractable cover. In general, a retractable cover runs on a set of generally parallel tracks installed along the length of the pool/spa, such as on the top surface of the deck, along a track formed below the deck surface, or along the vertical edges of the pool. Alternatively, the track may be a groove integrally formed in the sidewalls of the pool. The cover is extended and retracted along these tracks to cover/uncover the pool/spa. When not in use, the cover may be stored in an appropriately sized housing, box or container above-ground (above the deck), partially below the deck or below-ground (below the deck). The cover may also be simply rolled up on a roller and stored above ground (on the deck) without a box. Above-ground, the housing may be in the form of a bench or a box. Below ground, the housing may be concealed by a lid or cover that is positioned on or flush with the deck. In some embodiments, the housing may also house the motor and drums or other roller mechanisms, such as a rope reel system and roller drum, about which the cover is rolled or unrolled. In the case of an automatic or semi-automatic cover, the extension/retraction of the cover may be controlled by a controller, which may be automated, semi-automated or manual, and may include a key switch or a button, which is in communication with the motor.

Figure 1:
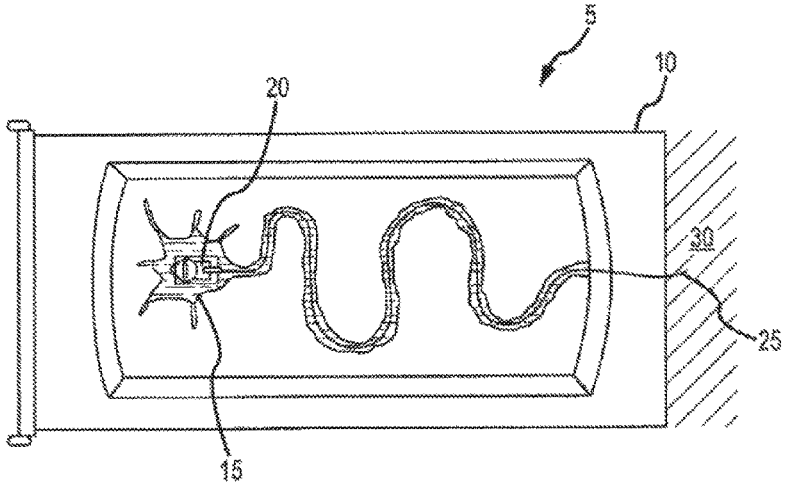
FIG.1 Prior Art
FIG. 1 depicts a pump placed on top of a pool/spa cover for water removal.
Figure 2:
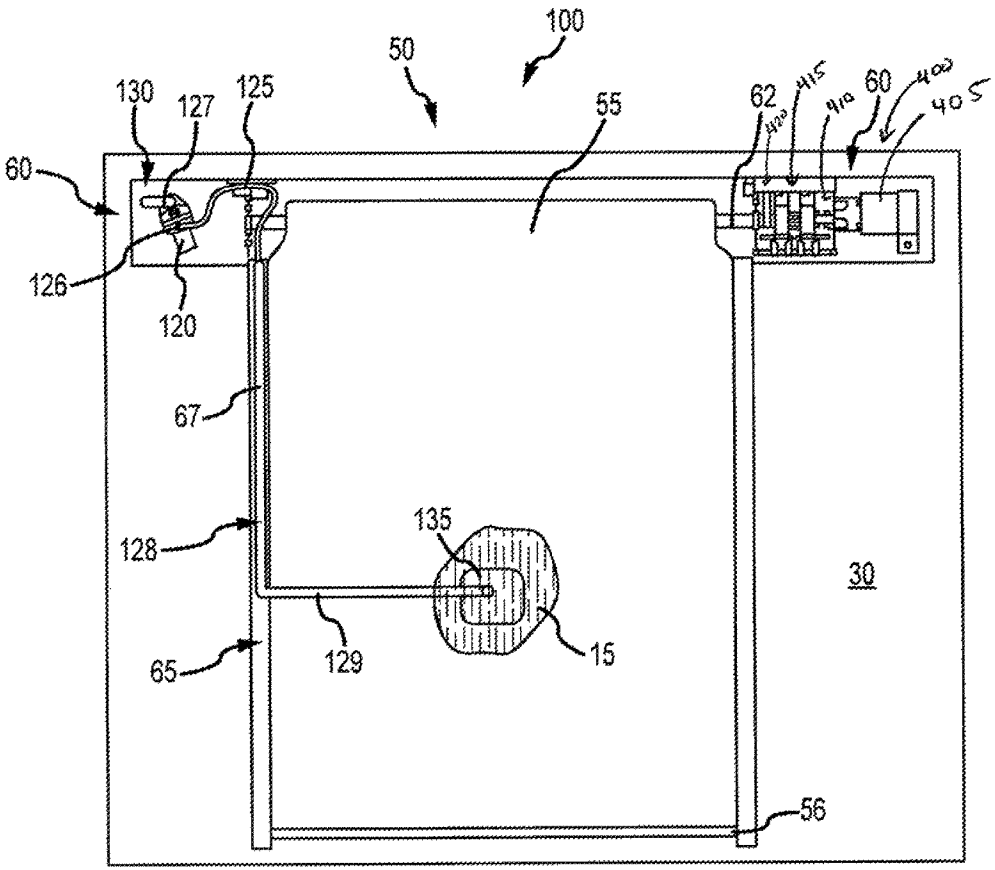
FIG. 2 depicts a top plan view of one embodiment of a remotely mounted pump in accordance with the present disclosure.

For a discussion of various embodiments of a remotely mounted pump system, reference is made to FIGS. 2-4B. In some embodiments, and as can be seen in FIG. 2, and others, the remotely mounted pump system 100 is used with a pool/spa cover system 50 that includes a pool/spa cover 55 and drums or other roller mechanism(s) 62 housed on or in a roller mechanism housing 60. The roller mechanism 62 operates to extend and retract the cover along at least a portion of the length of the pool. The cover system 50 may also include track channels 65 on opposite sides of the pool to receive the longitudinal edges of the cover 55 and guide them as the cover 55 is extended or retracted by its leading edge 56 along the sides of the pool while both extending and retracting the cover 55.

As shown in FIG. 2, the cover system 50 may also include a hose channel 67 positioned above or received by the track channel 65. In some embodiments, the hose channel is embedded in the deck 30. In some embodiments, the hose channel is embedded in the sidewall of the pool. In use, the cover 55 is operably coupled to the drums or other roller mechanism(s) 62 and the cover 55 may be extended or retracted along the track channels 65 by rolling the cover 55 in the appropriate direction about the drums 62 via a motor 405.

As shown in FIG. 2, in some embodiments, the motor is a part of an electric drive system 400 and may be a ¾ horsepower waterproof, submersible motor. The electric drive system 400 may also include a clutch feature 410, such as a slip clutch or an auto-shutoff feature. The slip clutch provides adjustable power and releases torque from the motor if the cover meets an obstacle. The auto-shutoff feature includes circuitry with a backup amp limiter that acts as an electronic slip clutch if the cover meets an obstacle. The electric drive system 400 may rotate the cover 55 about a rope-reel system 415 having a positive shift system 420 that is housed within an aluminum frame, and coupled to a roller drum 62 having hybrid end castings (hubs) (e.g. the drums or other roller mechanisms) to extend or retract the cover 55 along the track channels. In order to combat corrosion from either a chlorine or salt water pool environment, in some embodiments, the electric drive system 400 includes an anodized roller drum and hybrid end hubs and rope reels which use both stainless steel and polymers. In some embodiments, the cover 55 is made from a PVC vinyl, laminated over a reinforced polyester mesh. In other embodiments, a hydraulic drive system may be used.

FIG. 2 depicts a remotely mounted pump system 100 wherein the pump is remotely mounted at the roller mechanism housing 60. As shown in FIG. 2, in one embodiment, the system 100 may include a remotely mounted pump 120 and at least one fluid conduit, conduit, flexible tubing or hose 125. The pump 120 is mounted in the roller mechanism housing 60 by an appropriate fastening mechanism such as a bolting system. The pump 120 may further be coupled to a drain outlet 130 via a drain pipe or other fluid conduit 127 which is attached to transport the water out of the pump 120 and to the drain 130 located in or near the roller mechanism housing 60. The pump 120 may be a diaphragm pump, such as a FloJet motor driven diaphragm pump manufactured by Xylem FloJet, White Plains, N.Y. The diaphragm pump is effective to move volumes of water or air, which allows it to effectively move the collected water from the pool cover. It is contemplated that the pump may be a manually operated pump mechanism.

The conduit, flexible tubing or hose 125 includes a first end 126 and a second end 128. The first end 126 is coupled to the pump 120. The second end 128 of the hose 125 may include or be coupled to a detachable hose portion 129. The detachable hose portion 129 may include a discrete weight 135 at a distal end 131 of the hose portion 129. Alternatively, the weight may be distributed along the length of the hose. In some embodiments, the weight 135 may be integral with or otherwise secured to the cover 55 in order to create a depression in the cover 55 at which the water can accumulate. In some embodiments, the weight may be made of metal or a metal alloy. The shape of the weight may be round, or square or rectangular, or other appropriate shape to be placed in, around or along the length or any portion thereof of the conduit, flexible tubing or hose 125.

The conduit, flexible tubing or hose 125 may be a ribbon hose or other appropriate flat, discharge or suction hose or may be a hose suitable for suction or discharge. In general, a ribbon hose is made of a flexible material, such as vinyl, and has a plurality of channels that helps the hose have a wide and thin aspect ratio. In one embodiment, the height of the conduit 125 is as minimal as possible. In one embodiment, the height of the conduit 125 is ½" tall tubing stacked horizontally to about 4-6" wide. Where more or increased flow is desired, additional tubing is stacked together width-wise. The hose 125 aids in water removal at a desired flow rate. In one embodiment, the desired flow rate is approximately 5 gpm. In some embodiments, the flow rate is greater than 5 gpm, for example, 6 gpm, 7 gpm, 8 gpm, 9 gpm or 10 gpm. In some embodiments, the flow rate is within a range, such as between 5 gpm and 10 gpm.

In use, the hose 125 is coupled to the pump 120 via a quick connect or other releasable fitting or a threaded fitting and the hose 125 is guided along a portion of the perimeter of the pool via the hose channel 67. The detachable hose portion 129 is coupled to the second end 128 of the hose 125 via a quick connect or other releasable fitting or a threaded fitting and is placed on the pool cover 55 so that one end of the detachable hose portion 129 is positioned at a depressed location in the pool cover 55, which has collected the standing water 15. As noted above, in FIG. 2 the depressed location is created in part by a weight portion of the pool cover designed to pull the cover down and collect water therein.

To remove the water from the collection region, the free end of the detachable hose portion is placed in the collected water 15, and the pump is actuated. The pump draws the collected water into the hose under the action of the pump. The water then passes through the pump and out the exhaust of the pump to the drain. Once the standing water has been removed, the detachable hose portion 129 is removed from the hose second end 128 so as not to interfere with the retraction of the cover. Such a configuration is advantageous because the user only needs to remember to place and remove the hose. The user is no longer required to place, remove and monitor an on-cover (submersible) pump. Further, the remote mounted pump may be manually turned on or there may be a moisture sensor at the end of the hose operably connected to the pump or central control unit to automatically turn on the pump. Thus, the configuration increases user compliance and safety by providing a time-saving and easy to use standing water removal system.

Figure 3:
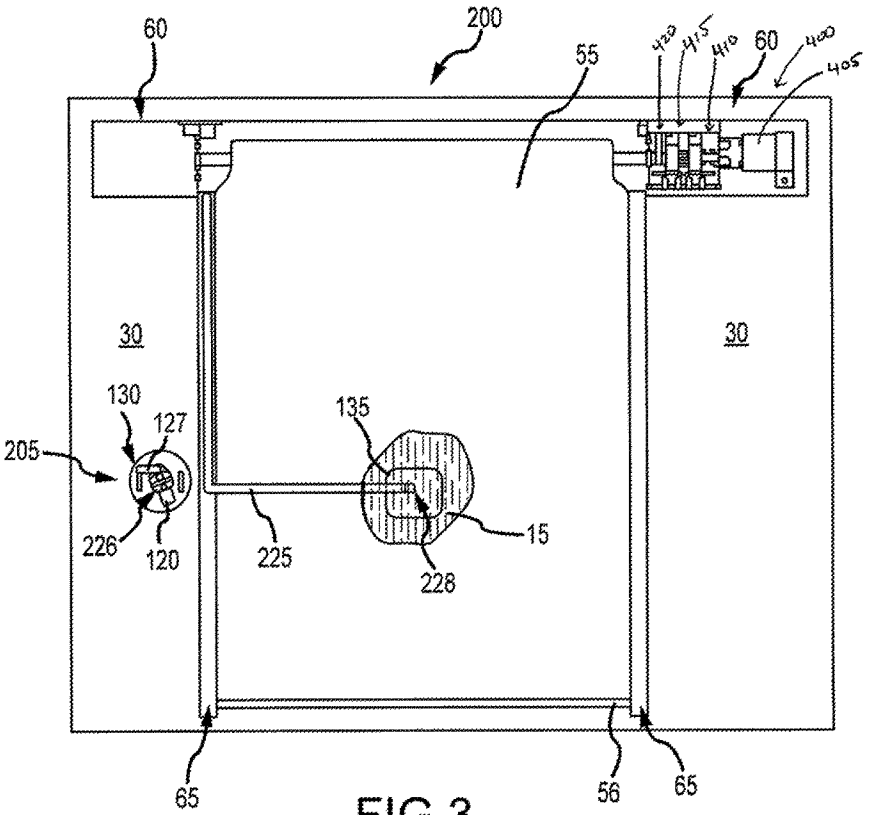
FIG. 3 depicts a top plan view of another embodiment of a remotely mounted pump in accordance with the present disclosure.

Turning now to FIG. 3, in another embodiment of a remotely mounted pump system, the pump 120 is remotely mounted in the deck 30. This deck mounted pump system 200 includes a pump 120 and at least one hose 225. The pump 120 is positioned in a recess 205 in the deck 30. The pump 120 may further be coupled to a drain outlet via a drainpipe or other fluid conduit 127 to transport the water out of the pump 120 and to the drain 130 located in or near the recess 205 in the deck 30. The pump 120 may be a diaphragm pump, such as a FloJet motor driven diaphragm pump manufactured by Xylem FloJet, White Plains, N.Y. The diaphragm pump is effective to move volumes of water or air, which allows it to effectively move the collected water from the pool cover. It is contemplated that the pump may be a manually operated pump mechanism.

Figure 5B:
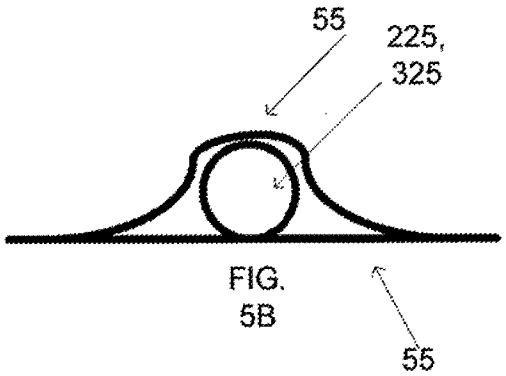
FIGS. 5A-5E depict cross-section views of a conduit and pool/spa cover that may be used with the remotely mounted pump in accordance with the present disclosure.
Figure 5D:
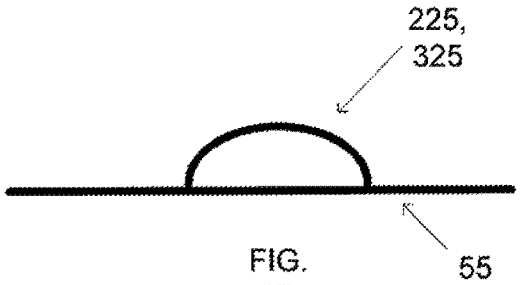
Figure 5E:
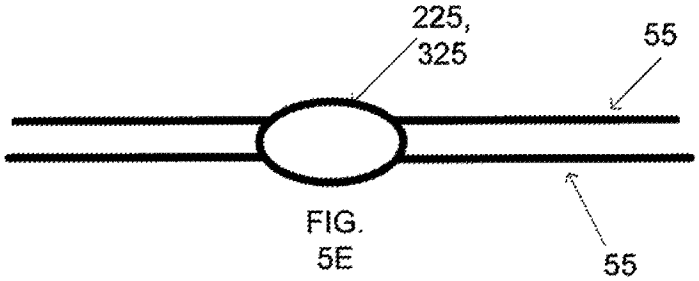
Figure 5A:
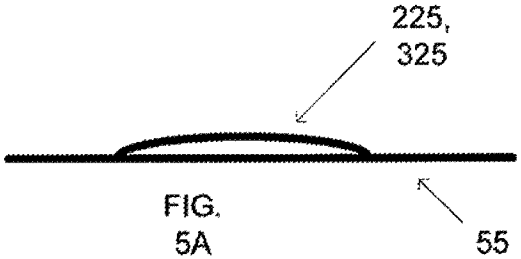
Figure 5C:
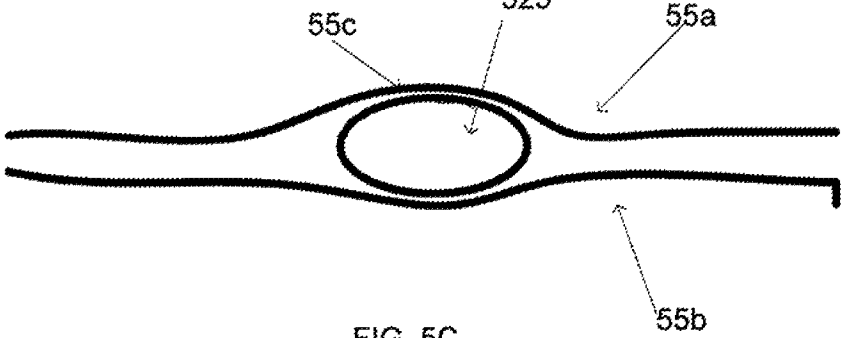

The conduit or hose 225 may be a flexible tubing or hose and may be a retractable hose having a first end 226 coupled to the pump 120 and a second end 228 configured for placement in a depression on the cover 55. The hose 225 may be wound about a drum or other retraction/extension mechanism that permits extension and retraction of the hose between the deck recess and the pool cover. See e.g., the discussion above related to an electric drive system 400. The conduit 225 may be a ribbon hose or other appropriate flat, discharge or suction hose or may be a hose suitable for suction or discharge. In general, a ribbon hose is made of a flexible material, such as vinyl, and has a plurality of channels that help the hose have a wide and thin aspect ratio that helps it lay flat on the pool cover and spread its weight across a larger area, see, e.g., FIG. 5A, which illustrates a conduit 225 lying flat on the cover 55. In other embodiments, the conduit 225 may be attached to, be integral with or formed by the cover, see, e.g., FIG. 5B which illustrates a conduit 225 attached to the cover 55; FIG. 5C which illustrates a conduit 225 inside or integral with the cover 55; and FIGS. 5D and 5E which illustrate a conduit 225 formed by the cover 55. A flat, ribbon hose, whether attached to, laying on top of, integral with or formed by a cover, will facilitate rolling up in the cover smoothly. In one embodiment, the height of the conduit 125 is as minimal as possible. In one embodiment, the height of the conduit 125 is ½" tall tubing stacked horizontally to about 4-6" wide. Where more or increased flow is desired, additional tubing is stacked together width-wise. The hose 225 may have other cross-sections, such as circular or oval. The hose 225 aids in water removal at a desired flow rate. In one embodiment, the desired flow rate is approximately 5 gpm. In some embodiments, the flow rate is greater than 5 gpm, for example, 6 gpm, 7 gpm, 8 gpm, 9 gpm or 10 gpm. In some embodiments, the flow rate is within a range, such as between 5 gpm and 10 gpm.

In some embodiments, the second end 228 of the hose 225 may include a weight 135 in order to create a depression in the cover 55 for standing water accumulation. In other embodiments, the weight 135 may be integrally formed in or secured on the cover 55 to create the depression. In some embodiments, the weight may be made of metal or a metal alloy. The shape of the weight may be round, or square or rectangular, or other appropriate shape to be placed in, around or along the length or any portion thereof of the conduit, flexible tubing or hose 225 or to be integrally formed or secured on the cover 55.

In use, the first end 226 of the hose 225 is coupled to the pump 120 via a quick connect or other releasable fitting or a threaded fitting. The second end 228 is pulled out of the recess and is placed in the standing water 15 to remove the water. To remove the water from the collection region, the second end of the hose is placed in the collected water 15, and the pump is actuated. The pump draws the collected water into the hose, and the water then passes through the hose to and through the pump, and out the exhaust of the pump to the drain. Once the standing water has been removed, the second end of the hose 228 is retracted so as not to interfere with the retraction of the cover. Such a configuration is advantageous because the user only needs to remember to place and remove the hose. The user is no longer required to place, remove and monitor an on-cover (submersible) pump. Further, the deck mounted pump may be manually turned on or there may be a moisture sensor at the end of the hose operably connected to the pump or central control unit to automatically turn on the pump. Thus, the configuration increases user compliance and safety by providing a time saving and easy to use standing water removal system.

Figure 4A:
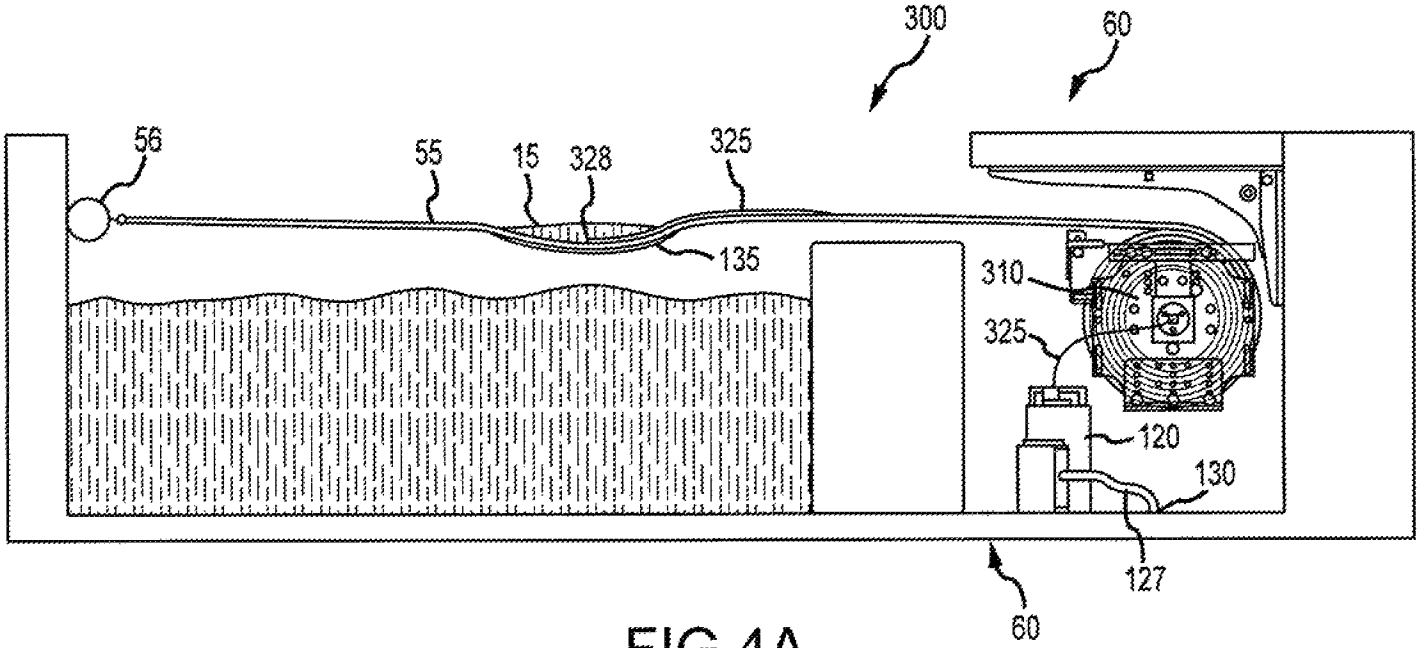
FIG. 4A depicts a side view of another embodiment of a remotely mounted pump in accordance with the present disclosure.
Figure 4B:
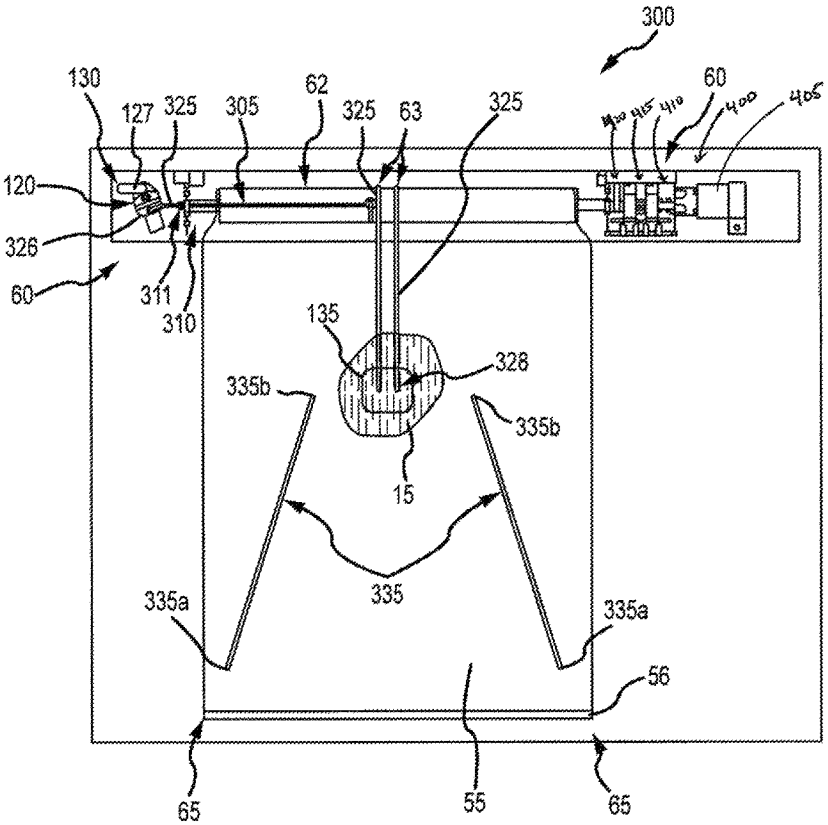
FIG. 4B depicts a top plan view of the remotely mounted pump of FIG. 4A.

FIGS. 4A and 4B depict side and top views of still another embodiment of a remotely mounted pump system. As can be understood from FIGS. 4A-4B, the system 300 may include a remotely mounted pump 120, at least one hose 325 and a retraction mechanism 310. The pump 120 is mounted in the roller mechanism housing 60 by an appropriate fastening mechanism such as a bolting system. The pump 120 may further be coupled to a drain outlet via a drainpipe or other fluid conduit 127 for transport of the water out of the pump 120 and to the drain 130 located in or near the roller mechanism housing 60. The pump 120 may be a diaphragm pump, such as a FloJet motor driven diaphragm pump manufactured by Xylem FloJet, White Plains, N.Y. The diaphragm pump is effective to move volumes of water or air, which allows it to effectively move the collected water from the pool cover. It is contemplated that the pump may be a manually operated pump mechanism.

The conduit, flexible tubing or hose 325 includes a first end 326 and a second end 328. The first end 326 is coupled to the pump 120. The second end 328 of the hose 325 may include a weight in order to create a depression in the cover 55 for standing water accumulation. In other embodiments, the weight 135 may be integral with or placed on or below the cover 55 to create the depression. In some embodiments, the weight may be made of metal or a metal alloy. The shape of the weight may be round, or square or rectangular, or other appropriate shape to be placed in, around or along the length or any portion thereof of the conduit, flexible tubing or hose 325 or to be integrally formed or secured on the cover 55. In some embodiments, the system includes one hose 325. In other embodiments, the system includes more than one hose 325, for example, two hoses or three hoses.

The conduit, flexible tubing or hose 325 may be a ribbon hose or other appropriate flat, discharge or suction hose or may be a hose suitable for suction or discharge. In general, a ribbon hose is made of a flexible material, such as vinyl, and has a plurality of channels that help the hose have a wide and thin aspect ratio that helps it lay flat on the pool cover and spread its weight across a larger area, see, e.g., FIG. 5A, which illustrates a conduit 325 lying flat on the cover 55. In other embodiments, the conduit 325 may be attached to, be integral with or formed by the cover, see, e.g., FIG. 5B which illustrates a conduit 325 attached to the cover 55; FIG. 5C which illustrates a conduit 325 inside or integral with the cover 55; and FIGS. 5D and 5E which illustrate a conduit 325 formed by the cover 55. A flat, ribbon hose, whether attached to, laying on top of, integral with or formed by a cover, will facilitate rolling up in the cover smoothly. In one embodiment, the height of the conduit 325 is as minimal as possible. In one embodiment, the height of the conduit 325 is ½" tall tubing stacked horizontally to about 4-6" wide. Where more or increased flow is desired, additional tubing is stacked together width-wise. The hose may have other cross-sections, such as circular or oval. In some embodiments, each hose 325 may have four passageways or fluid conduits through which the water flows. The hose 325 aids in water removal at a desired flow rate. In one embodiment, the desired flow rate is approximately 5 gpm. In some embodiments, the flow rate is greater than 5 gpm, for example, 6 gpm, 7 gpm, 8 gpm, 9 gpm or 10 gpm. In some embodiments, the flow rate is within a range, such as between 5 gpm and 10 gpm.

The system may further include channel weights 335 configured to channel water into one general location on the cover near the end 328 of the hose 325. The channel weights 335 may be elongated flexible members having some weight extending along their length to create a linear depression along the cover 55 where they are placed. In one embodiment, they are placed at an angle with their distal ends 335*a* spaced further apart than their adjacent ends 335*b*, which are located at or near the weight. This arrangement helps direct water contacting the pool cover 55 to flow toward the depression. The channel weights 335 may be flexible, and integrally formed with or secured on the top or bottom surfaces of the cover 55 to create the channel to the depression. If integrally formed with or secured to the pool cover, the channel weights 335 may roll up and unroll with the pool cover. The channel weights 335 may also be removable from the cover when not in use. In some embodiments, the channel weights may be made of metal or a metal alloy. The shape of the weights may be round, or square or rectangular, or other appropriate shape to be placed in, around or along the length or any portion thereof of the conduit, flexible tubing or hose 325 or to be integrally formed or secured on the cover 55.

The hose 325 is received by the retraction mechanism 310. The retraction mechanism 310 may include a drum 62 with a hose channel or tube 305 formed there through. In use, the hose 325 is coupled to the pump 120 at a first end 326 and is received by the hose channel 305 in the drum 62 via a live swivel 311. The swivel 311 creates a watertight seal between the hose 325 and the retraction mechanism 310. The swivel 311 allows the hose to connect from the pump through the end wall of the drum and permits the drum to rotate to extend and retract the cover and hose without interference from the hose.

The hose 325 extends from the swivel 311 through a hose tube or channel 305 formed in the drum 62 and exits out of an aperture 63 formed in the outer wall of the drum 62 to be positioned on the top of the pool cover 55 as the pool cover is extended. The second end 328 of the hose 325 is positioned at the depression where the water collects. In one embodiment, the hose 325 is located on top of the cover 55 as it exits the drum 62, and rolls up with and extends with the drum. As can be understood from FIG. 5C, in some embodiments, the cover 55 includes a top 55*a* and bottom sheet 55*b* or portion, and the hose 325 is located between these top and bottom sheets. In such an embodiment, the top sheet may further include a small screen 55*c* at the area where the water is collected (such as where the weight is located) so that the water passes through the screen and contacts the hose end. The screen may be a wire or plastic lattice, or may be one aperture or a series of apertures formed in a region sufficient to allow the collected water to move to the second or free end 328 of the hose.

In use, the first end 326 of the hose 325 is coupled to the pump 120 via a quick connect or other releasable fitting or a threaded fitting. The second free end 328 is extended out of the drum 62 with the pool cover 55 and is positioned on top thereof. The weights 135 or channel weights 335 create a depression for water collection in the cover at or near the second end 328 of the hose 325. To remove the water from the collection region, the pump is actuated to draw the collected water into the hose. The water passes through the hose under the suction of the pump, through the pump, and out the exhaust of the pump to the drain. Once the standing water has been removed, the pump may be turned off.

Such a configuration is advantageous because the user is no longer required to place, remove and monitor an on-cover (submersible) pump or a place and remove a separate suction hose. Further, the remotely mounted pump may be manually turned on or there may be a moisture sensor at the end of the hose operably connected to the pump to actuate the pump when needed, or a central control unit may be operably connected to automatically turn on the pump based on user settings. Thus, the configuration increases user compliance and safety by providing a timesaving and easy to use standing water removal system.

In the above description, it is contemplated that the pool cover is a structure that extends over at least a portion of a pool, spa, or the like. The pool cover may or may not be attached continuously or at discrete locations along at least one edge of the rim or other external structure of the pool. The pool cover may be manually extended over the pool and manually removed from the pool, or the pool cover may be extended over the pool and removed from the pool by an automatic system, such as being rolled up onto a roller positioned at one end of the pool. The roller may be operated manually or automatically. The pool cover may be flexible material such as vinyl or other types of plastics, and may include other materials in layered or integral form for added strength of function (such as heat retention). The pool cover may also be a combination of rigid and flexible materials, such as slats, that may collect water at low points on the top surface. Other structures of pool covers that collect standing water that needs removal are contemplated as the type of pool cover is not an important feature for many, any, or all of the embodiments of the examples described herein.

All directional references (e.g., proximal, distal, upper, lower, upward, downward, left, right, lateral, front, back, top, bottom, above, below, vertical, horizontal, clockwise, and counterclockwise) are only used for identification purposes to aid the reader's understanding of the present invention, and do not create limitations, particularly as to the position, orientation, or use of the invention. Connection references (e.g., attached, coupled, connected, and joined) are to be construed broadly and may include intermediate members between a collection of elements and relative movement between elements unless otherwise indicated. As such, connection references do not necessarily infer that two elements are directly connected and in fixed relation to each other. The exemplary drawings are for purposes of illustration only and the dimensions, positions, order and relative sizes reflected in the drawings attached hereto may vary.

The above specification, examples and figures provide a complete description of the structure and use of exemplary embodiments of the invention as claimed below. Although various embodiments of the invention as claimed have been described above with a certain degree of particularity, or with reference to one or more individual embodiments, those skilled in the art could make numerous alterations to the disclosed embodiments without departing from the spirit or scope of this invention. Other embodiments are therefore contemplated. It is intended that all matter contained in the above description and shown in the accompanying drawings shall be interpreted as illustrative only of particular embodiments and not limiting. Changes in detail or structure may be made without departing from the basic elements of the invention as defined in the following claims.

What is claimed is:

1. A system for removing standing water from a pool/spa cover, the system comprising a diaphragm pump mounted in a remote location relative to the pool/spa cover of a pool/spa;

one or more weights coupled to the pool/spa cover to create a depression into which standing water will accumulate; and at least one hose having a first end and a second end, the first end coupled to an inlet in the diaphragm pump and the second end configured to be received in the depression in the pool/spa cover; and a drain coupled to the diaphragm pump via a fluid conduit, wherein:

the remote location is a roller mechanism housing or a recess in a pool deck, and the drain is located at and discharges at the remote location to remove the standing water from the pool/spa cover and away from the pool/spa.

2. The system of claim 1 further comprising a retraction mechanism coupled to the diaphragm pump and the pool/spa cover via the at least one hose.

3. The system of claim 1 wherein the one or more weights is operably associated with the at least one hose.

4. The system of claim 3 wherein the at least one hose is integral with the pool/spa cover.

5. The system of claim 1 wherein the at least one hose further comprises a detachable hose portion coupled to the second end of the at least one hose.

6. The system of claim 1 further comprising channel weights positioned in or on the cover to create a channel which enables the standing water to collect in the depression in the cover.

7. The system of claim 1, wherein the at least one hose is a ribbon hose or a flat hose.

8. A system for removing standing water from a pool/spa cover, the system comprising a diaphragm pump mounted in a remote location relative to the pool/spa cover of a pool/spa;

at least one hose having a first end and a second end, the first end coupled to an inlet in the diaphragm pump and the second end comprising one or more weights to create a depression in the pool/spa cover into which standing water will accumulate, the second end configured to be received in the depression in the pool/spa cover; and a drain coupled to the diaphragm pump via a fluid conduit, wherein:

the remote location is a roller mechanism housing or a recess in a pool deck, and the drain is located at and discharges at the remote location to remove the standing water from the pool/spa cover and away from the pool/spa.

9. The system of claim 8 further comprising a retraction mechanism coupled to the diaphragm pump and the pool/spa cover via the at least one hose.

10. The system of claim 8 wherein the at least one hose is a ribbon hose or a flat hose.

11. The system of claim 10 wherein the at least one hose is integral with the pool/spa cover.

12. The system of claim 8 wherein the at least one hose further comprises a detachable hose portion coupled to the second end of the at least one hose.

13. The system of claim 8 further comprising channel weights positioned in or on the cover to create a channel for the standing water to collect in the depression in the cover.

14. A method of removing standing water from a pool/spa cover comprising coupling a first end of at least one hose to a diaphragm pump, the diaphragm pump mounted in a remote location relative to a pool/spa;

extending a second end of the at least one hose onto or through the cover to a collection of standing water formed in a depression, wherein the depression is created by one or more weights positioned on the cover or about the second end of the at least one hose; and removing the collected standing water from the cover by actuation of the diaphragm pump to discharge the standing water to a drain, the drain positioned at and discharging at the remote location to remove the standing water away from the pool/spa.

15. The method of claim 14 further comprising creating a channel in the cover to direct the standing water to the depression.

16. The method of claim 14 further comprising retracting the at least one hose from the depression, wherein the retracting operation is at least partially performed by a retracting mechanism positioned in a roller mechanism housing.

17. The method of claim 16 wherein the extending operation is at least partially performed by the retracting mechanism positioned in the roller mechanism housing.

18. The method of claim 14 wherein the extending operation is at least partially performed by extending the pool/spa cover.

19. The method of claim 14 wherein the at least one hose is a ribbon hose or a flat hose.

* * * * *